US008459199B2

(12) United States Patent
Proutiere et al.

(10) Patent No.: US 8,459,199 B2
(45) Date of Patent: Jun. 11, 2013

(54) EXTERNAL STORAGE DEVICE FOR DEPLOYING WEAPONS FROM A SUBMARINE

(75) Inventors: Severine Proutiere, Magnac sur Touvre (FR); Nicolas Dupin, Angouleme (FR); Philippe Lubrano-Lavaderci, Angouleme (FR)

(73) Assignee: DCNS, Paris (FR)

( * ) Notice: Subject to any disclaimer, the term of this patent is extended or adjusted under 35 U.S.C. 154(b) by 263 days.

(21) Appl. No.: 12/936,438

(22) PCT Filed: Apr. 7, 2009

(86) PCT No.: PCT/FR2009/050600

§ 371 (c)(1),
(2), (4) Date: Oct. 5, 2010

(87) PCT Pub. No.: WO2009/136065

PCT Pub. Date: Nov. 12, 2009

(65) Prior Publication Data

US 2011/0030608 A1 Feb. 10, 2011

(30) Foreign Application Priority Data

Apr. 9, 2008 (FR) ..... 08 52378

(51) Int. Cl.
*B63G 8/28* (2006.01)

(52) U.S. Cl.
USPC ..... 114/317; 114/312; 114/321

(58) Field of Classification Search
USPC ..... 114/21.2, 317, 318, 320, 321, 312
See application file for complete search history.

(56) References Cited

U.S. PATENT DOCUMENTS 3,368,510 A * 2/1968 Humphrey ..... 114/317
5,363,791 A 11/1994 Stallard, III
5,675,117 A * 10/1997 Hillenbrand ..... 114/21.2

FOREIGN PATENT DOCUMENTS

DE 639 488 C 12/1936
DE 295 15 885 U1 11/1996
EP 0 850 830 A2 7/1998

OTHER PUBLICATIONS

International Search Report, dated Dec. 7, 2009, from corresponding PCT application.

* cited by examiner

*Primary Examiner* — Lars A Olson
(74) *Attorney, Agent, or Firm* — Young & Thompson

(57) ABSTRACT

A weapon storage device (10) which is to be attached to an external face (8) of a hull (4) of a submarine (2) and which is capable of containing weapons (14), such as ammunition or weapon carriers, which are to be deployed from the storage device on receipt of a deployment signal transmitted from inside the submarine, includes a compensation element (16, 18, 30, 40) which allows the variation in mass of the storage device (10) resulting from the deployment of at least one weapon to be compensated for, partially or wholly, by replacing a volume of gas initially contained in the storage device by an identical volume of water introduced into the storage device.

11 Claims, 3 Drawing Sheets

EXTERNAL STORAGE DEVICE FOR DEPLOYING WEAPONS FROM A SUBMARINE

The present invention relates to a weapon storage device which is to be attached to an external face of a hull of a submarine and which is capable of containing weapons which are to be deployed from the storage device on receipt of a deployment signal transmitted from inside the submarine.

In the following, the term "weapon" is understood as meaning any type of ammunition (mine, torpedo, missile, etc.) or weapon carrier (drones, etc.).

Document DE 295 15 885 U1 describes such an external storage device which is attached, in a removable manner, to the side of the hull of a submarine.

Such a storage device enables a submarine to be versatile by allowing it to take on board the weapons corresponding to the mission with which it is assigned at a given time.

However, while the submarine is balanced initially, the deployment of a weapon, such as the launching of a mine by gravity, causes a loss of mass of the storage device, which destabilises the submarine. Because the storage device is located on the side of the submarine, the loss of mass in fact produces both a destabilising moment that tends to make the submarine rotate about its longitudinal axis (list imbalance) and a destabilising moment that tends to make the submarine rotate about a transverse axis (trim imbalance). The submarine then loses some of its stability and therefore some of its manoeuvrability.

The destabilising effect is particularly great on submarines of low tonnage, for example less than about 1500 tonnes, for which the loss of mass of the storage device following the deployment of a weapon is proportionally greater.

Hitherto, the effects of such a destabilising moment have been neutralised by the submarine itself. For example, by using the ballast device with which it is equipped, the submarine generates an opposite moment to the destabilising moment so as to correct the list and/or trim. However, this solution is not always sufficient, in particular in the case of a submarine of low tonnage, which is able to correct to only a small extent the imbalances produced by successive and relatively considerable losses of mass. This solution is all the less sufficient because a ballast device is designed to control the trim of the submarine, that is to say the rotational movements of the submarine about its transverse axis and not the rotational movements about its longitudinal axis.

According to another method of neutralising the effects of the destabilising moment, as is proposed, for example, in the document mentioned above, the submarine has two weapon storage devices disposed on each of the two sides of the hull. By means of a weapon deployment process which alternates between the use of the port storage device and the starboard storage device, the stability of the submarine is more or less maintained during the mission and the deployment of the weapons. However, this method reduces the variety of storage devices which can be mounted on the hull of the submarine, because identical storage devices must be positioned on each side of the submarine in order to be able to carry out this method of neutralisation. Accordingly, the versatility of the submarine is reduced. Moreover, this method lacks flexibility in terms of the use of the storage devices mounted on the submarine, because the deployment of a weapon from one side must be followed by the deployment of the same weapon from the other side. Finally, the submarine remains unbalanced during the lapse of time separating two successive deployments.

It is therefore an object of the invention to remedy the problems mentioned above by proposing an improved storage device which allows the stability of the submarine to be affected only very slightly by the deployment of a weapon initially contained in the storage device, while retaining very good flexibility of use of the storage device.

The invention therefore relates to a weapon storage device of the above-mentioned type, characterised in that it comprises a compensation means which allows the variation in mass of the storage device resulting from the deployment of at least one weapon to be compensated for, partially or wholly, by replacing at least a volume of gas initially contained in the storage device by an identical volume of water introduced into the storage device.

According to particular embodiments, the storage device has one or more of the following features, taken in isolation or in any technically possible combinations:

- the compensation means comprises: a compensation tank composed of at least one reservoir which can contain gas and/or water; a purging means which allows the gas initially contained in the compensation tank to be discharged; and an admission means which allows water to be introduced into the compensation tank;
- the purging means comprises a means for injecting the gas discharged from the compensation tank into the submarine;
- the admission means is calibrated so that it allows a basic and predetermined volume of water to be admitted on each actuation;
- the storage device is removable;
- the purging means and the admission means comprise hydraulic actuators, so that the storage device is autonomous;
- the storage device comprises a compensation control means capable of generating a control signal for the compensation means.

The invention relates also to a submarine having a hull and a weapon storage device attached to an external face of the hull, the storage device being as defined above.

According to particular embodiments, the submarine has one or more of the following features, taken in isolation or in any technically possible combinations:

- the storage device is positioned on the hull so that its centre of gravity is situated, in projection along the longitudinal axis of the submarine, close to the centre of thrust of the submarine;
- the gas initially contained in the storage device is air, and that air, when discharged from the storage device, is injected into an air circuit with which the submarine is equipped.

The invention and its advantages will be better understood upon reading the following description, which is given solely by way of example and with reference to the accompanying drawings, in which.

Figure 1:
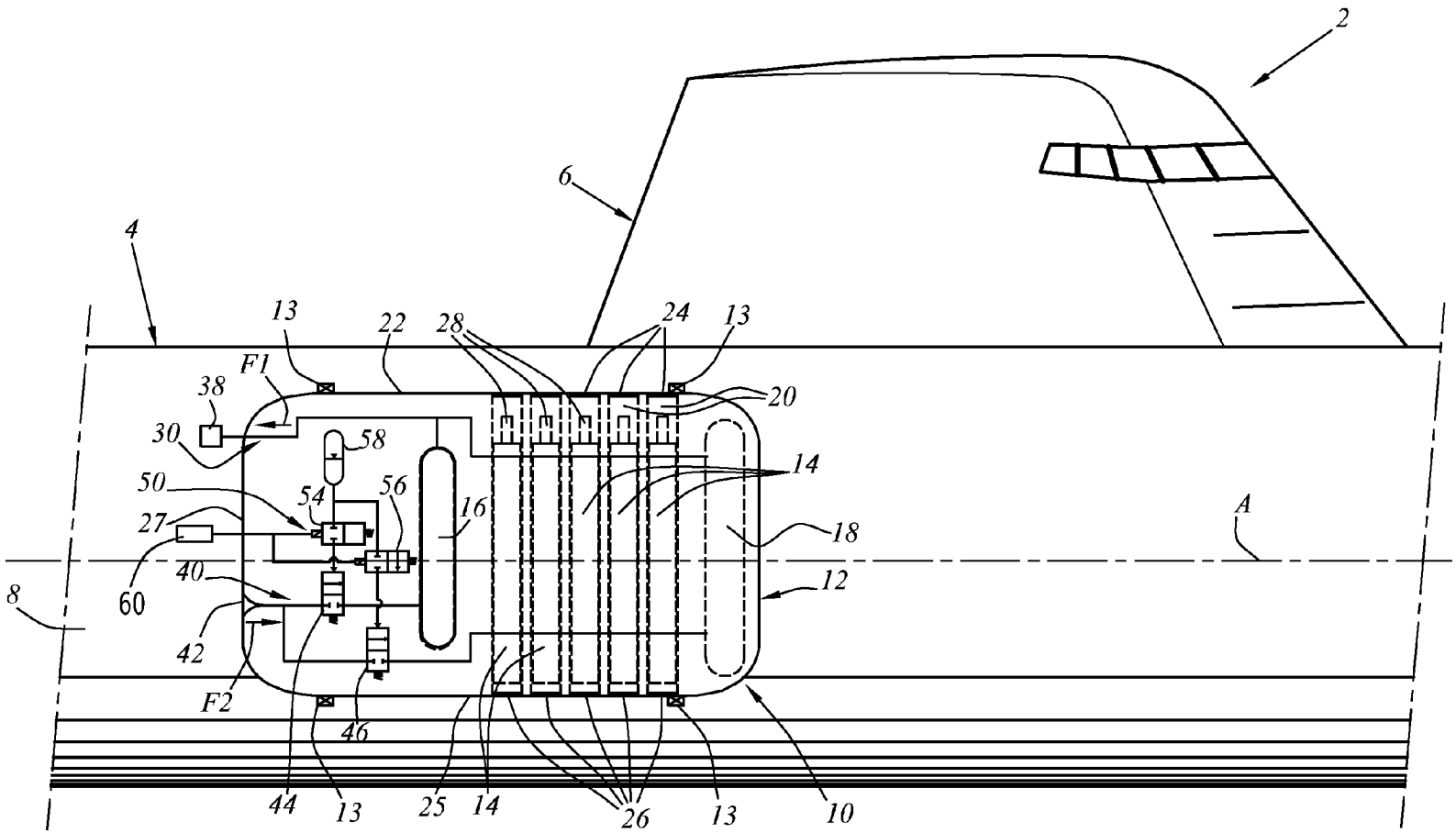
FIG. 1 is a side view of a preferred embodiment of the storage device according to the invention, attached to the starboard side of a submarine.
Figure 2:
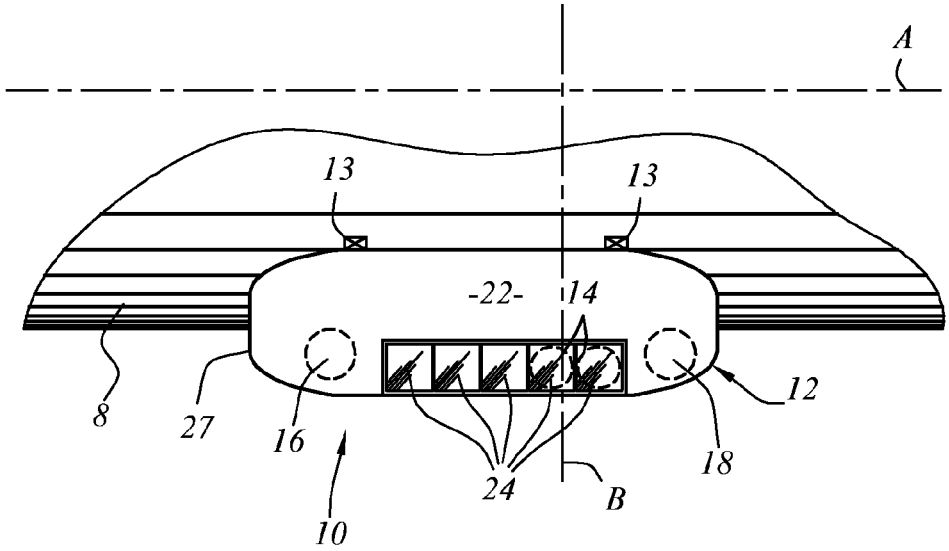
FIG. 2 is a top view of the device of FIG. 1.
Figure 3:
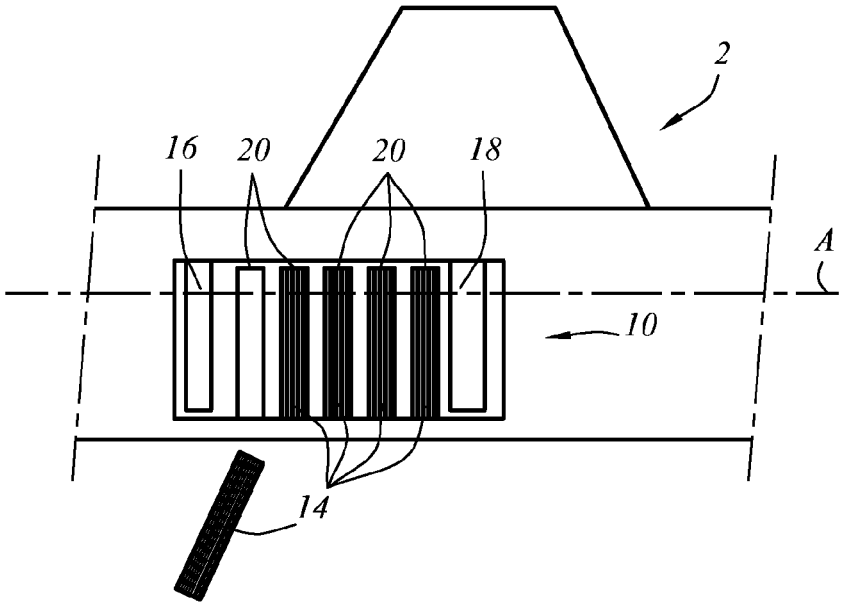
FIGS. 3 to 6 show, in diagrammatic form, different stages of a process for using the device of FIGS. 1 and 2.
Figure 4:
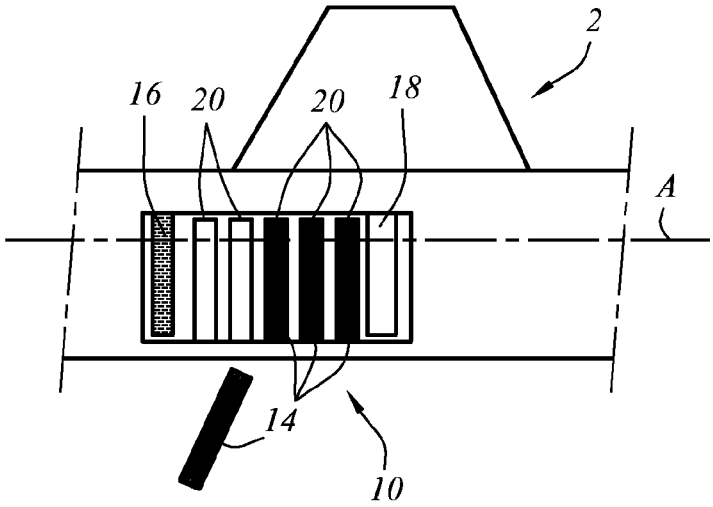
Figure 5:
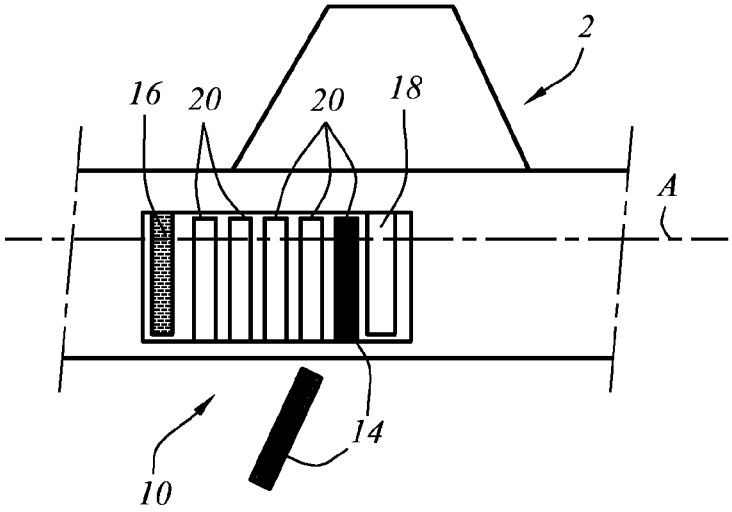
Figure 6:
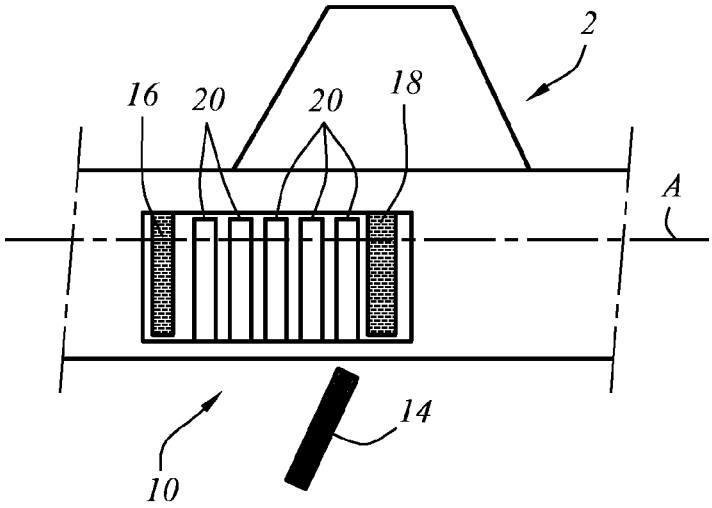

FIG. 1 shows part of a submarine 2 having an outer hull 4 and a conning tower 6 arranged above the hull 4. The hull 4 is generally cylindrical in shape about the longitudinal axis A of the submarine 2.

A storage device 10 is attached to an external face 8 of the hull 4, and on the starboard side of the submarine 2, which storage device 10 is to receive weapons which can be deployed from the storage device 10 on receipt of a deployment signal.

The storage device 10 has on the outside a housing 12 which has a shape inscribed in a rectangular parallelepiped and is capable of cooperating with the hull 4 during attachment of the storage device 10 to the submarine 2. Accordingly, the face of the housing 12 that faces the hull 4 has a convexity complementary to that of the external face 8 of the hull 4 so that the two faces fit together. The housing 12 is attached to the hull 4 by fixing means 13 adapted to allow the device 10 to be removable. The person skilled in the art knows how to design such fixing means.

The housing 12 has on the inside a plurality of silos 20, on the one hand, each of which is to receive a weapon 14, and a compensation means, on the other hand, for compensating for the loss of mass resulting from the deployment of one of the weapons 14.

The compensation means is composed of two compensation tanks, a rear compensation tank 16 and a front compensation tank 18, which are capable of containing air and/or water, a purging means 30 for discharging the air from the rear 16 and front 18 compensation tanks, and an admission means 40 for introducing water into the rear 16 and front 18 compensation tanks.

The housing 12 has internal, vertical subdivisions which delimit a plurality of silos 20. In the embodiment shown in the figures, the storage device 10 has five silos 20 which are aligned to form a row parallel to the axis A. Each silo 20 is closed by a door 24 in the region of an upper face 22 of the housing 12, and by a trap 26 in the region of a lower face 25 of the housing 12.

In the embodiment described, the weapon 14 is a mine. It is inserted vertically into a silo 20, from top to bottom, while the door 24 of the corresponding silo 20 is open. The mine 14 is placed on the trap 26 of the corresponding silo 20 and is held by a retaining means 28 which is in the form of a stop finger fixed to the inside wall of the silo 20 and engaged in a notch provided in the upper portion of the mine 14. After opening of the trap 26, the mine 14 is deployed from the silo 20 by simply actuating the retaining means 28 for opening. Actuation is carried out on receipt of a signal of deployment of the mine 14 transmitted from inside the submarine 2. The mine 14 is then dropped from the device 10 by simple gravity.

A silo 20 is not tight. Accordingly, when it contains a weapon 14, the volume of the silo 20 situated between the weapon 14 on the one hand and the lateral walls of the silo 20, the door 24 and the trap 26 thereof on the other hand is filled with water.

When the mine 14 is deployed, the volume V of the mine 14 is replaced by an identical volume of water. The loss of mass $\Delta M$ resulting from the deployment of the mine 14 therefore corresponds to: $\Delta M=(d-1)\times m\times V$, where "d" is the density relative to water of the mine 14 and "m" is the density of the water.

The rear compensation tank 16 is situated behind the row of silos 20, according to the longitudinal axis A of the submarine 2 oriented from left to right in FIG. 1. The rear compensation tank 16 is a closed reservoir of cylindrical shape which is arranged vertically. The rear compensation tank 16 is in fluid communication with the purging means 30 on the one hand and with the admission means 40 on the other hand.

Similarly, the front compensation tank 18 is situated in front of the row of silos 20. It is a cylindrically shaped reservoir which is arranged vertically and is in fluid communication with the purging means 30 and the admission means 40. The height of the front compensation tank 18 is greater than that of the rear compensation tank 16. Their diameters are equal, so the front compensation tank 18 has a larger internal volume than does the rear compensation tank 16. The reasons for this particular arrangement will become apparent during the following description of a use of the device 10.

The purging means 30 is connected, upstream, according to the flow arrow F1, to the rear 16 and front 18 compensation tanks and, downstream, to an air recovery element 30 located on board the submarine 2 and belonging to a ventilation system thereof.

The admission means 40 is connected, upstream, according to the flow arrow F2, to a water admission nozzle 42 located on a rear face 27 of the housing 12, and, downstream, to the rear 16 and front 18 compensation tanks by way of rear 44 and front 46 hydraulic valves, respectively.

The rear 44 and front 46 hydraulic valves are 2/2 valves actuated for opening by pressure. The actuating pressure is generated by an oil-operated secondary "hydraulic" circuit 50 which comprises, inter alia, rear 54 and front 56 solenoid valves and a "hydraulic" pressure accumulator 58. Under the effect of a compensation control signal applied to the rear solenoid valve 54, the latter switches from its default closed state to its open state, permitting application of the pressure generated by the accumulator 58 under the control of the rear hydraulic valve 44. Under the effect of that pressure, the rear hydraulic valve 44 switches from its default closed state to its open state, placing the water admission nozzle 42 and the rear compensation tank 16 in communication. Because the external water pressure is greater than the pressure of the air contained in the rear compensation tank 16, the water rushes into the rear compensation tank 16 and expels the air that is present. The air is purged to the air recovery element 38.

A similar description may be made of the admission of water into the front compensation tank 18 when a compensation control signal is applied to the front solenoid valve 56 in order to actuate the front hydraulic valve 46.

By means of the hydraulic system just described, the storage device 10 is autonomous, in the sense that it does not need an external energy source to function. The only source of energy available to the storage device 10 is in the hydraulic pressure accumulator 58, which is capable of generating mechanical work.

The person skilled in the art will know how to modify the circuits and hydraulic elements described in this particular embodiment of the storage device according to the invention in order to ensure correct operation thereof. For example, the purging means can advantageously include a safety valve which is positioned between the rear 16 and front 18 compensation tanks, on the one hand, and the air recovery element 38 and is capable of preventing water from being supplied from the rear 16 and front 18 compensation tanks to the air recovery element 38.

The compensation control signal applied to the rear 54 and front 56 solenoid valves is generated by a compensation control means 60 located on board the submarine 2. In a variant, the compensation control means comprises a plurality of sensors, each sensor being associated with a silo 20 and being capable of detecting dropping of the mine 14 contained in the silo 20, the compensation control means automatically applying a compensation control signal to a particular solenoid valve on receipt of a detection signal generated by one of the sensors.

A possible use of the storage device 10 will now be described with reference to FIGS. 3 to 6, which show successive steps of the deployment of the mines 14 from a storage device which, by way of example, has five silos 20.

While the submarine 2 is berthed, an empty storage device 10 is brought up to the hull 4 by means of a crane. The storage device 10 is attached to the outside face 8 of the hull 4 by means of the fixing means 13. The storage device 10 is positioned along the hull 4 so that the centre of gravity of the device 10, once loaded, is situated, according to the longitudinal axis A of the submarine 2, close to the centre of thrust of the submarine 2. The compensation tanks 16 and 18 are at this time filled with air. The purging means 30 is connected hydraulically to the air recovery element 38, and the solenoid valves 54 and 56 are connected electrically to the compensation control means 60 located on board the submarine 2.

Mines 14 are then placed in succession into each of the five silos 20 by being inserted vertically from above. This operation is also carried out by means of a crane.

At sea, during the mission, deployment of the group of five mines 14 is carried out as follows, the silos 20 and the mines 14 being arranged from back to front according to the axis A.

The first mine 14 is dropped. As indicated above, when a mine 14 is deployed, the volume V of the mine 14 is replaced by an identical volume of water. There results a loss of mass ΔM.

The loss of mass resulting from the deployment of the first mine 14 is not corrected by the submarine 2, which continues its mission with a certain angle of list.

The second mine 14 is then dropped. The admission means 40 is then actuated, indirectly via the secondary hydraulic circuit, on receipt, by the storage device 10, of a control signal generated by the compensation control means 60 either by an operator having a man-machine control interface or automatically in synchronisation with the generation of the signal for deployment of the second mine 14. The air contained in the rear tank 16 is expelled by the sea water introduced into the rear compensation tank 16. Actuation of the rear hydraulic valve 44 is then stopped. In the embodiment described, the whole of the volume of the rear compensation tank 16 is filled with water during this first compensation step.

Following the first compensation step, the mass of the volume of water admitted to the rear compensation tank 16 compensates fully for the loss of mass 2×ΔM associated with the deployment of the first and second mines 14. The submarine 2 then regains its initial stability with a zero angle of list.

Then, as the mission continues, the third and fourth mines are dropped. The corresponding loss of mass 2×ΔM is not corrected by the submarine 2, which has an angle of list.

Finally, after the fifth mine 14 has been deployed, the admission means 40 is actuated in order to expel the volume of air contained in the front compensation tank 18 and replace it with a volume of water. During this second compensation step, the totality of the volume of the front compensation tank 18 is used to compensate for the loss of mass 3×ΔM resulting from the deployment of the last three mines 14 dropped.

Because the front compensation tank 18 is provided to compensate for the deployment of three mines 14 whereas the rear compensation tank 16 is provided to compensate for the deployment of two mines 14, it will be understood that the volume of the front compensation tank 18 is greater than that of the rear compensation tank 16.

In another embodiment of the storage device, the front and rear hydraulic valves are calibrated so that, on actuation, they admit a basic volume of water which is predetermined. It is then possible to use the storage device in such a manner that, after the deployment of each of the mines 14, a mass of water equal to the loss of mass ΔM is admitted to one of the rear 16 or front 18 compensation tanks. Optionally, a calibrated hydraulic valve will be actuated several times so that the mass of water ultimately admitted, which corresponds to a multiple of the basic mass admitted in the event of an actuation, is close to the loss of mass ΔM.

In yet another embodiment of the storage device according to the invention, a single compensation tank is located in the centre of the row of silos 20. By means of this arrangement, like the preceding one, the centre of gravity of the storage device does not move during the deployment of the weapons.

It will be noted that the fact of expelling the air initially contained in the compensation tanks 16 and 18 to the inside of the submarine 2 has the advantage of reducing the sound signature of the submarine 2 equipped with the storage device 10 during the compensation steps. However, that particular arrangement of the device according to the invention is only an alternative. The person skilled in the art will know how to modify the described device in order to eliminate or reduce the volume of gas emptied from the compensation tank.

The invention claimed is:

1. A storage device which is to be attached to an external face (8) of a hull (4) of a submarine (2) and which is capable of containing weapons (14), which are to be deployed from the storage device on receipt of a deployment signal transmitted from inside the submarine, comprising:

a means for compensating which allows variation in mass of the storage device (10) resulting from deployment of at least one weapon to be compensated for, partially or wholly, by replacing at least a volume of gas initially contained in the storage device by an identical volume of water introduced into the storage device, the means for compensating comprising:

a compensation tank (16, 18) composed of at least one reservoir which can contain gas and/or water;

a means for purging (30) which allows the gas initially contained in the compensation tank to be discharged; and a means for admitting (40) which allows water to be introduced into the compensation tank;

wherein the means for purging (30) comprises a means for injecting the gas discharged from the compensation tank into the submarine.

2. The storage device according to claim 1, wherein the means for admitting is calibrated to admit a basic and predetermined volume of water to on each actuation.

3. The storage device according to claim 1, wherein the storage device is removable.

4. The storage device according to claim 1, wherein the means for purging (30) and the means for admitting (40) comprise hydraulic actuators, so that the storage device (10) is autonomous.

5. The storage device according to claim 4, wherein the means for admitting is connected, upstream, to a water admission nozzle and, downstream, to the compensation tank by way of a hydraulic valve.

6. The storage device according to claim 5, wherein the hydraulic valve is a 2/2 valve constructed and arranged to actuate for opening by an actuating pressure, which is generated by an oil-operated secondary hydraulic circuit (50) comprising a solenoid valve and a pressure accumulator.

7. The storage device according to claim 1, further comprising a means for controlling compensation capable of generating a control signal for the means for compensating.

8. A submarine comprising a hull (4) and the storage device (10) according to claim 1 attached on an external face (8) of the hull.

9. The submarine according to claim 8, wherein the storage device (10) is positioned on the hull (4) so that a center of gravity of the storage device is situated, in projection along a longitudinal axis of the submarine, close to a center of thrust of the submarine (2).

10. The submarine according to claim 8, wherein the at least the volume of gas initially contained in the storage device (10) is air, and wherein the air, when discharged from the storage device, is injected into an air circuit (38) with which the submarine (2) is equipped.

11. The storage device according to claim 1, wherein the means for purging is connected, upstream, to the compensation tank and, downstream, to an air recovery element located on board the submarine and belonging to a ventilation system thereof.

* * * * *